US009293126B2

(12) United States Patent
Zambon et al.

(10) Patent No.: US 9,293,126 B2
(45) Date of Patent: Mar. 22, 2016

(54) SYSTEM TO REPRODUCE THE SOUND OF A STRINGED INSTRUMENT

(71) Applicants: Stefano Zambon, Dueville (IT); Eugenio Giordani, Pesaro (IT); Federico Fontana, Porcia (IT); Balazs Bank, Budapest (HU)

(72) Inventors: Stefano Zambon, Dueville (IT); Eugenio Giordani, Pesaro (IT); Federico Fontana, Porcia (IT); Balazs Bank, Budapest (HU)

(73) Assignee: VISCOUNT INTERNATIONAL S.P.A., Mondaino (RN) (IT)

( * ) Notice: Subject to any disclaimer, the term of this patent is extended or adjusted under 35 U.S.C. 154(b) by 0 days.

(21) Appl. No.: 14/385,110

(22) PCT Filed: Mar. 11, 2013

(86) PCT No.: PCT/EP2013/054874
§ 371 (c)(1),
(2) Date: Sep. 12, 2014

(87) PCT Pub. No.: WO2013/135627
PCT Pub. Date: Sep. 19, 2013

(65) Prior Publication Data

US 2015/0068390 A1 Mar. 12, 2015

(30) Foreign Application Priority Data

Mar. 13, 2012 (IT) ..... AN2012A0023

(51) Int. Cl.
*G01P 3/00* (2006.01)
*G10H 5/00* (2006.01)
*G10H 1/18* (2006.01)

(52) U.S. Cl.
CPC ..... *G10H 5/002* (2013.01); *G10H 1/18* (2013.01); *G10H 5/007* (2013.01); *G10H 2250/451* (2013.01); *G10H 2250/511* (2013.01)

(58) Field of Classification Search
CPC ..... G10H 5/007; G10H 1/18; G10H 5/002; G10H 2250/451; G10H 2250/511
USPC ..... 84/658
See application file for complete search history.

(56) References Cited

U.S. PATENT DOCUMENTS 7,285,718 B2 * 10/2007 Sasaki ..... 84/744
7,435,895 B2 * 10/2008 Muramatsu ..... 84/741
7,598,448 B2 * 10/2009 Ohba ..... 84/626
8,013,233 B2 * 9/2011 Komatsu ..... 84/724

FOREIGN PATENT DOCUMENTS

EP 2261891 A1 12/2010
WO 2013135627 A1 9/2013

OTHER PUBLICATIONS

International Search Report for corresponding International Application No. PCT/EP2013/054874.
Balazs Bank et al., "A Modal-Based Real-Time Piano Synthesizer", IEEE Transactions on Audio, Speech adn Language Processing, IEEE Service Center, New York, NY USA vol. 18, No. 4, May 1, 2010, pp. 809-821.

* cited by examiner

*Primary Examiner* — Jianchun Qin
(74) *Attorney, Agent, or Firm* — Egbert Law Offices, PLLC

(57) ABSTRACT

A system is used to reproduce the sound of a stringed instrument and provided with hammers to strike the strings. The system has a speed detector coupled with each hammer to detect the percussion velocity on the string, a plurality of note modules receiving in input a signal representative of the hammer velocity and generating a force signal ($F_{tot}$) representative of the global partial components of the string vibration, and a soundboard-instrument body module receiving in input said signal of the global partial components ($F_{tot}$) from each note module and generating two electrical signals (left, right) adapted to drive two electroacoustic transducers for sound emission.

8 Claims, 10 Drawing Sheets

SYSTEM TO REPRODUCE THE SOUND OF A STRINGED INSTRUMENT

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present patent application for industrial invention relates to a system used to reproduce the sound of a stringed instrument, in particular a piano, by means of modeling and digital synthesis of the oscillatory components, or partials, due to the excitation of the string constrained together with the other strings of the instrument, as in the case of the piano strings.

2. Description of Related Art Including Information Disclosed Under 37 CFR 1.97 and 37 CFR 1.98.

The most common methodology used in the digital synthesis of the sound of musical instruments consists of storing a collection of sounds sampled from real musical instruments in the memory of a synthesis device. The samples can be pre-processed before storage and are successively reproduced in real time, during the synthesis, adding a post-processing that aims at adapting them to the player's requirements. Said processing modifies the recorded sounds in variable extent through dedicated computing resources, thus permitting proportional processing before storage. With the increase of computing resources, samples can be simplified in wavetable format or additionally reduced to few data in the memory according to wave-shaping techniques.

A methodology alternative to the use of samples provides for completely synthesizing the sound of the instrument by means of physical models. By simulating the dynamics of specific components of the musical instrument, these models imitate what happens in reality when a component typically identified as "exciter" stresses the remaining part of the model, identified as "resonator". In the case of a piano, the use of hammer-string models based on digital waveguides is known, which are able to reproduce the motion of the string at the bridge, starting from the information on the impact velocity of the hammer on the string; then, the corresponding motion signal is processed by a discrete-time realization of a model of the soundboard without feedback effects on the string model (see Bank et al., EURASIP journal on Applied Signal Processing, vol. 2003, pp. 941-952, 2003).

In between the two aforementioned methodologies is the class of methods that make use of physical models, whose excitation is performed by injecting in the model a signal that is an indirect function of the force impressed by the player.

With reference to the piano, the known models are the digital waveguide model excited by the hammer-soundboard-instrument body assembly (known as commuted synthesis, see Smith, U.S. Pat. No. 5,777,255), and the additive synthesis model of damped sinusoidal components informed by finite elements of the string-soundboard assembly, excited by signals measured directly from the piano, i.e. obtained from simulations made on physical models comparable to the ones described in the previous paragraph (see Guillaume, U.S. Pat. No. 7,915,515 B2).

The aforementioned prior art, in the context of piano simulation, does not provide for the realization of a method by means of a digital device, in which a scalable model of the strings (resonator) is stressed by a hammer model (exciter) according to the force impressed on the key by the player, thus generating a sound that is then sent to a post-processing step that takes into account the action of the soundboard-instrument body on the previously generated sound. The theoretical foundations of such a method are known from the literature (see Balázs Bank, Stefano Zambon, and Federico Fontana, pp 809-821, IEEE Transactions on Audio, Speech and Language Processing, Vol 18, No 4, May 2010): in particular, the same theory guarantees the rendering of all partials generated by the strings of a standard 88-key piano, as well as of the oscillatory components deriving from the longitudinal motion of the strings.

EP 2 261 891 discloses a method used to synthesize tone signals and a system used to generate tone signals, in particular for electronic pianola.

The primary purpose of the present invention is to eliminate the drawbacks of the prior art and realize a system based on the interconnection of a hammer, strings, and soundboard-instrument body model to synthesize digital piano sounds through the rendering of all oscillatory partial and transient longitudinal components of the instrument in different playing conditions.

An additional purpose is to provide a realization of the hammer, strings, and soundboard-instrument body model as much accurate as possible in terms of sound realism, and as much efficient as possible in terms of computational cost.

Another purpose is to provide a realization of the hammer and strings model allowing for fine tuning of the simulated instrument, similarly to what occurs in the real instrument when hammers and strings are tuned.

BRIEF SUMMARY OF THE INVENTION

The present invention is based on certain assumptions that are known from the vast literature that quantifies the measurable characteristics of piano sound depending on the mechanical characteristics of the instrument and its operation in different playing conditions. Based on these assumptions, and using the quantitative results proposed by the same literature that can be used to set the operating parameters, the present invention provides for modeling:

a. the dynamics of the hammer force, which varies according to the velocity exerted when playing the respective key;
b. the audible oscillatory components depending on how the force propagates on the struck strings and on the remaining strings by means of motion transmission along the strings;
c. the variable decay of the oscillatory components in order to reproduce the so-called phenomenon of double decay of partial components of the musical instrument;

d. the control on the decay time of the notes by the player through releasing the corresponding keys and gradually using the right pedal (herein defined as "resonance pedal");

e. the synthesis of components herein defined as "primary", due to the partial oscillatory components (herein defined as "linear") of the strings directly excited by the hammer, and to the oscillatory components (herein defined as "quadratic") due to the tension modulation of the strings directly excited by the hammer;

f. the synthesis of the oscillatory components herein defined as "longitudinal" due to the longitudinal waves propagating along the strings directly excited by the hammer;

g. the synthesis of the oscillatory components herein defined as "secondary" that, being directly excited by the hammer, interfere with the primary oscillatory components, originating beats in the envelope of the partial components of the strings excited by the hammer, and additionally sympathetically excited by the other strings in view of the mechanical energy transmission along the strings;

h. the synthesis of the oscillatory components herein defined as "duplex" due to the so-called duplex scale, additionally enriching the sympathetic vibration of the musical instrument;

i. the global processing effects by the soundboard-instrument body assembly on the partial oscillatory components generated by the strings in correspondence of multiple interaction points at the bridge between strings and soundboard;

j. the sound coming from the soundboard-instrument body assembly as a result of two different signals, reproducible by means of standard audio devices, such as loudspeakers or stereophonic headphones.

The system of the invention leads to two main advantages:

i) each partial component can be independently realized through the use of a corresponding digital resonator filter, thus avoiding any constraint in terms of belonging to a predefined series of partials as required by the approach based on digital waveguides anyhow excited. In other words, the use of a scalable model for the strings based on digital resonator filters, as proposed by the present method, overcomes the lack of flexibility that is typical of the methodologies based on digital waveguides, in the definition of the series of partials associated with each string. Vice versa, such flexibility is translated into the possibility of tuning the digital instrument without being subject to any constraint inherent to the technology;

ii) the same filter can be referred both to a partial belonging to a directly excited string and to a partial belonging to a string excited by energy transmission from another string, thus also overcoming the models based on the direct excitation of damped sinusoidal components globally generated by the musical instrument. In view of the above, the model based on digital resonator filters is able to reproduce the energy transmission dynamics between the strings. Such a model overcomes the methodologies based on additive synthesis, in which the reproduction of energy transmission between the strings is not dynamically reproducible, and must be described in advance in the model. This involves the need to define in advance, for each partial directly excited by the hammer, as many damped oscillatory components as the partials excited by means of energy transmission from the directly excited partial, with consequent enormous growth of the dimension of the additive synthesis bank in order to compete with the accuracy offered by the reproduction of energy dynamics of the strings through the use of resonator filters.

BRIEF DESCRIPTION OF THE DRAWINGS

For a better understanding the description of the system of the invention continues with reference to the enclosed drawings, wherein.

DETAILED DESCRIPTION OF THE INVENTION

Figure 1:
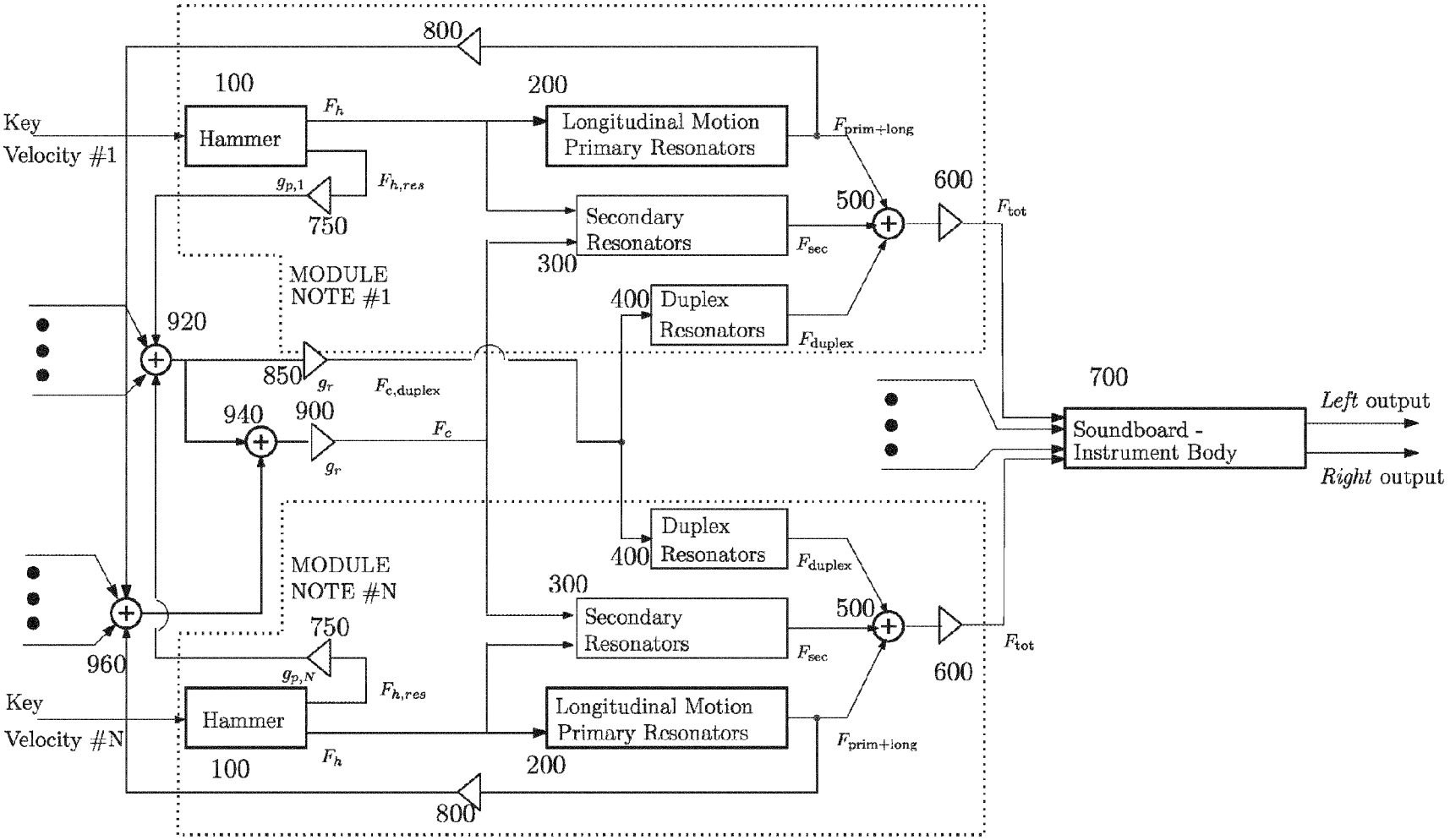
FIG. 1 is a general block diagram of the system used to synthesize a stringed instrument, in particular a piano, according to the invention.

Referring to FIG. 1, the system of the invention is disclosed, generally indicated with numeral (1).

The system (1) comprises a number N of note modules equal to the number of hammers of the musical instrument. If the stringed instrument is a piano, for instance, the number N of note modules is 88, just like a standard 88-key piano provided with 88 hammers hitting the strings.

Each note module comprises a hammer module (100), a primary resonator and longitudinal motion module (200), a secondary resonator module (300) and a duplex resonator module (400).

The information on the impact velocity of the hammer of each key played on a keyboard is instantaneously directed to the corresponding hammer module (100). In the keyboards of standard digital pianos, such information is typically detected by measuring the flight time of the hammer between two predefined points, one of them being situated immediately in the proximity of the impact point on the corresponding strings.

Figure 2:
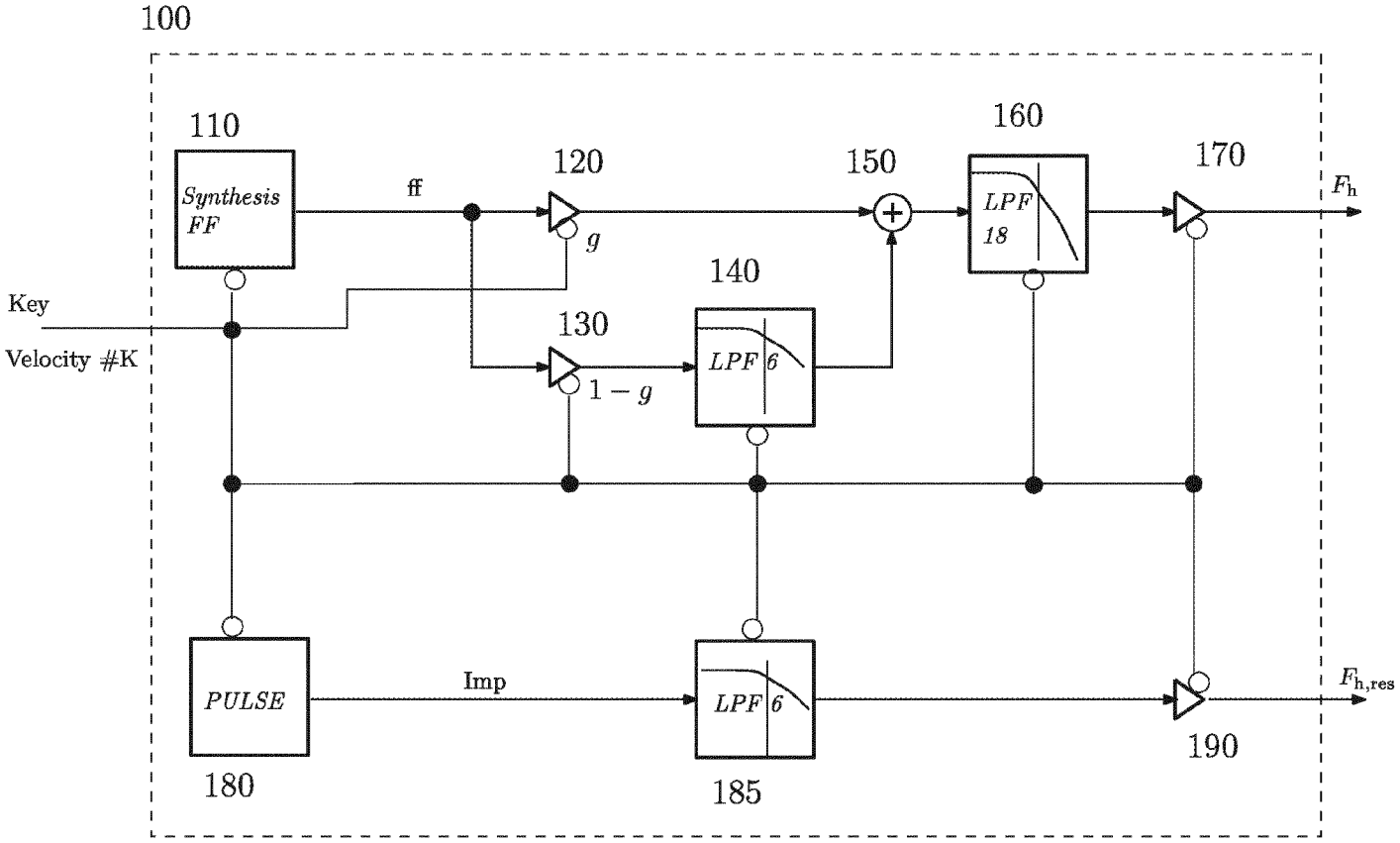
FIG. 2 is a block diagram that illustrates a module of FIG. 1 in detail, realizing a hammer that excites the strings of a key of the piano, producing the generic (K-th) note.

Referring to FIG. 2, the information on the impact velocity of the hammer producing the K-th note enables the instantaneous generation of a force signal from the hammer module (100). Such a force is initially rendered by:

a) a continuous signal generator (110) generating a force signal (ff) that reproduces the evolution across time of the force exerted by the hammer over the strings of the key when playing ff ("fortissimo") dynamics;

b) an pulse signal generator (180) generating a signal (Imp) herein defined as "resonance impulse" that reproduces the evolution across time of the force transmitted to all strings by the hammer when playing ff dynamics.

As it is known in the prior art, the force signal (ff) can be determined from measurements made on real musical instruments, or from simulations made on physics-based sound models able to simulate the hammer-string system of the piano in different playing conditions, including ff dynamics (see Balázs Bank, Stefano Zambon, and Federico Fontana, pages 809-821, IEEE Transactions on Audio, Speech and Language Processing, Vol 18, No 4, May 2010).

Instead, the resonance impulse (Imp) can be obtained in a known way as residual signal from the same measurements or simulations, through the use of techniques capable of decorrelating the harmonic part from a note attack transient.

The force signal (ff) is divided in two portions with complementary amplitude by means of respective gain blocks (120, 130). The first gain block (120) has gain (g) comprised between 1 and 0, whereas the second gain block (130) has gain (1−g). The purpose of the two gains (120, 130) is to weigh, upon varying the impact velocity of the hammer associated with the key, the action of two low-pass filters (140, 160) with variable cut-off frequency. The first low-pass filter (140) has a slope of 6 dB (140) and is installed downstream the second gain block (130). The second low-pass filter (160) has a slope of 18 dB and is installed downstream an adder (150) that sums the output from the first gain block (120) to the output of the first low-pass filter (140).

The gain blocks (120, 130) can be designed according to standard digital signal processing techniques: by controlling gain g in a range from 0 to 1 proportionally to the velocity, and summing by means of the adder (150) the outputs from the respective weighed branches, downstream the second filter (160), an equivalent low-pass effect is obtained with slope of 6+18=24 dB for null velocity and gain because of the action in series of filters (140) and (160) on the force signal (110).

Vice versa, for g values close to 1, a low-pass filtering with slope of 18 dB would be obtained, due to the action of the second filter (160) only, the first filter (140) being no longer fed by a sufficiently wide input.

In actual fact, such a system provides for progressively increasing the cut-off frequency of both filters (140, 160) upon increasing the gain g: in such a way, the low-pass effect due to the first filter (140) is progressively attenuated together with the amplitude of the signal entering the filter, whereas likewise the low-pass effect due to the second filter (160) is attenuated contextually to a proportional increase of the amplitude of the force signal (ff) directly entering the second filter (160).

The global effect of such a control on gain g and simultaneously on the cut-off frequencies of filters (140) and (160) is the optimization of the slope of the spectrum of the force signal (ff) at the different hammer velocities exerted by the player. A global scaling of the signal is operated by means of a third gain block (170) installed downstream the second filter (160). A force signal $F_h$ is generated by the third gain block (170). The third gain block (170) is a function of the impact velocity of the hammer. This also optimizes the amplitude of the force signal $F_h$ outgoing from the hammer module (100).

In parallel to the force signal (ff), the resonance impulse (Imp) is subject to the action of a third low-pass filter (185) identical to the first low-pass filter (140) and successively to the action of a fourth gain block (190) identical to the third gain block (170). The fourth gain block (190) generates a resonance impulse signal ($F_{h,res}$) as a function of the impact velocity of the hammer.

Both the third filter (185) and the fourth gain block (190) are controlled by the impact velocity of the hammer just like their respective equivalents (140) and (170). The presence of the third filter (185) and the fourth gain block (190) allows for simultaneously reducing resonances and controlling the amplitude of the resonance impulse (180), respectively. In this way, an evolution of the resonance impulse signal ($F_{h,res}$) as a function of the impact velocity of the hammer is obtained.

Figure 3:
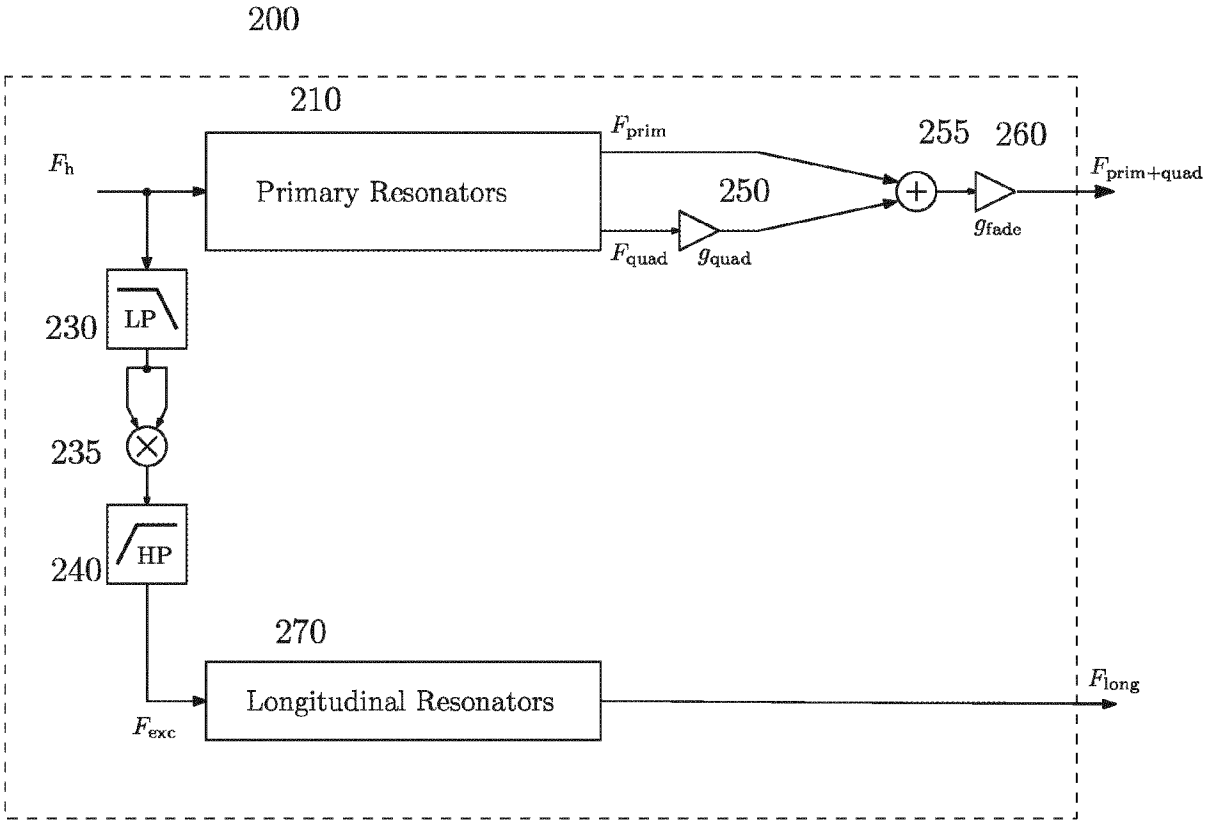
FIG. 3 is a block diagram that illustrates a module of FIG. 1 in detail, realizing the synthesis of the primary oscillatory components of the strings producing the K-th note of the piano and the synthesis of the longitudinal oscillatory components of the strings of the same note.

Referring to FIGS. 1 and 3, the force signal ($F_h$) outgoing from the hammer module (100) is sent to the primary and longitudinal resonator module (200) that realizes the synthesis of the primary and longitudinal oscillatory components for the K-th note.

As shown in FIG. 3, the module (200) comprises a primary resonator module (210) and a longitudinal resonator module (270). The force signal ($F_h$) enters the primary resonator module (210) that generates both a signal ($F_{prim}$) that contains information relative to the linear components, and a signal ($F_{quad}$) that contains information relative to the quadratic components.

The signal of the quadratic components ($F_{quad}$) is scaled by means of a first gain block (250). Then, the two signals are summed by means of an adder (255) and the signal obtained is scaled again by means of a second gain block (260) obtaining in output the primary component signal ($F_{prim+quad}$).

The spectral components which lay above one fourth of the sampling frequency of the system are removed from the force signal ($F_h$) by means of a low-pass filter (230). As it is known from the digital signal processing theory, the signal outgoing from the low-pass filter (230) can be squared by means of a multiplier (235), without incurring in the known frequency aliasing phenomenon. The squared signal is filtered by means of a high-pass filter (240) with cut-off frequency set one octave below the fundamental longitudinal frequency of the K-th note, in such manner to obtain an excitation signal ($F_{exc}$). Moreover, having removed the continuous component of the signal outgoing from the multiplier (235) by means of the filter (240), the excitation signal ($F_{exc}$) meets the conditions to feed the longitudinal resonators (270) that synthesize the longitudinal oscillatory components. The longitudinal resonators (270) generate a longitudinal component signal ($F_{long}$) that contains the longitudinal oscillatory components of the K-th note.

Figure 9:
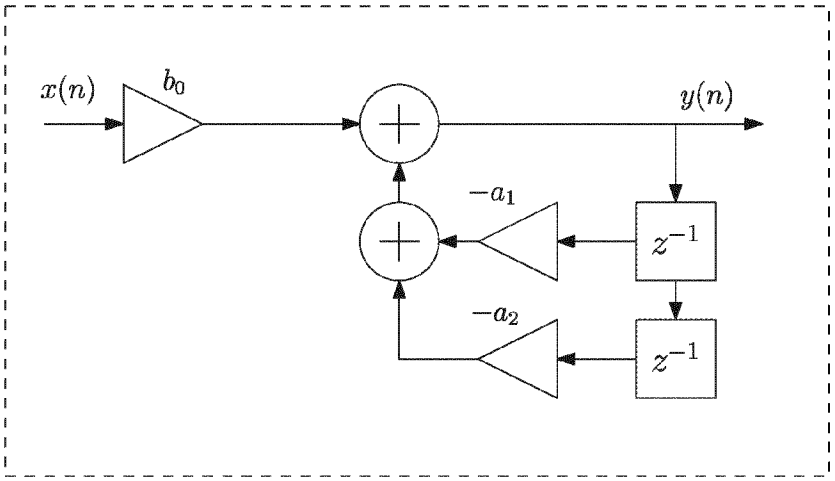
FIG. 9 is a block diagram that illustrates the realization of each resonator used in the system of the invention.

Referring to FIG. 9, being x(n) and y(n) two signals respectively incoming to and outgoing from a digital filter operating at a given sampling frequency $F_s$ of the system, each resonator filter used in the system of the invention obeys to a single input/output relation known from the discrete-time signal processing theory: $y(n)=b_0x(n)-a_1y(n-1)-a_2y(n-2)$, wherein $b_0$, $a_1$ and $a_2$ are coefficients that completely characterize gain parameters $A_k$, resonance frequency $f_k$ and decay time $T_k$ of the signal outgoing from the k-th resonator filter according to the following relations:

$$b_0=A_k\exp(-1/(F_sT_k))\sin(2\pi f_k/F_s)$$

$$a_1=-2\exp(-1/(F_sT_k))\cos(2\pi f_k/F_s)$$

$$a_2=\exp(-2/(F_sT_k))$$

Said input/output relation is realized by the filter illustrated in FIG. 9, wherein the blocks identified with symbol $z^{-1}$ represent memory locations able to receive and retain a signal sample for a time equal to $1/F_S$, making it available at the respective output for the processing that will take place in correspondence of the following sampling interval of the system.

The system of the invention uses resonator filters, such as the one illustrated above, with decay time parameters $T_k$ controlled in such a way to dynamically vary the decay of each partial oscillatory component of the simulated instrument further to excitation of the corresponding string by the hammer. For each partial oscillatory component the decay dynamics is governed by alternatively selecting three values $T_k'$, $T_k''$ and Tk''' for the respective resonator filter, which are predefined during the design stage based on data from decay measurements of partial components in a real piano.

Figure 10:
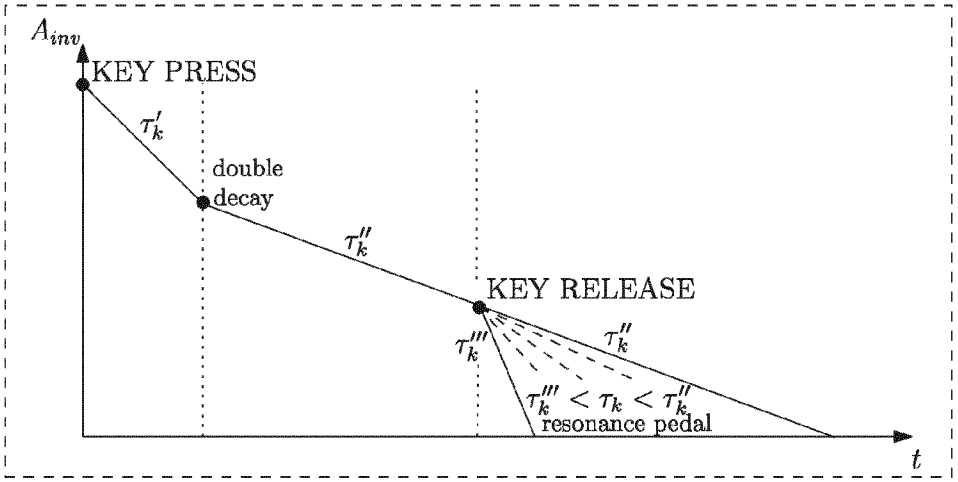
FIG. 10 is a Cartesian plot that illustrates the evolution across time of the amplitude envelope of a single partial component, depending on the values of the decay time parameter of the resonator, in presence of double decay, of the key release and of the possible action of the resonance pedal of the piano.

Referring to the time/amplitude envelope diagram illustrated in FIG. 10 for a generic partial component (herein defined as "k-th"), it can be noted that by making a suitable variation from value $T_k'$ to value $T_k''$ of the decay time at a given moment of the operation of the k-th resonator, it is possible to effectively simulate a double decay of the partial belonging to the string excited by the corresponding hammer. Moreover, with a variation to value $T_k'''$, it is possible to accurately simulate the damping on the same partial from the moment when the key is released until the complete stop of the oscillation.

Additionally, FIG. 10 illustrates the effects of different levels of the resonance pedal of the piano on the amplitude envelope of the k-th partial component when the key acting on the corresponding string is not pressed. In lack of pressure on the pedal, as mentioned above, attenuation follows a decay time equal to value $T_k'''$. Upon increasing the pressure on the pedal, the decay time with non-pressed key gradually migrates towards the value $T_k''$. Since the resonance pedal acts simultaneously on all strings of the instrument, at the maximum pressure limit on the resonance pedal, the attenuation of partial components is equal to the attenuation that would occur if the player maintained all keys of the instrument pressed. In such manner, by weighing the resonance pedal, the player can select at any time, for the strings that correspond to non-pressed keys, decay time values of each proportionally associated partial comprised between the corresponding minimum and maximum attenuation value (respectively, $T_k'''$ and $T_k''$ in case of the k-th partial illustrated in FIG. 10).

Figure 4:
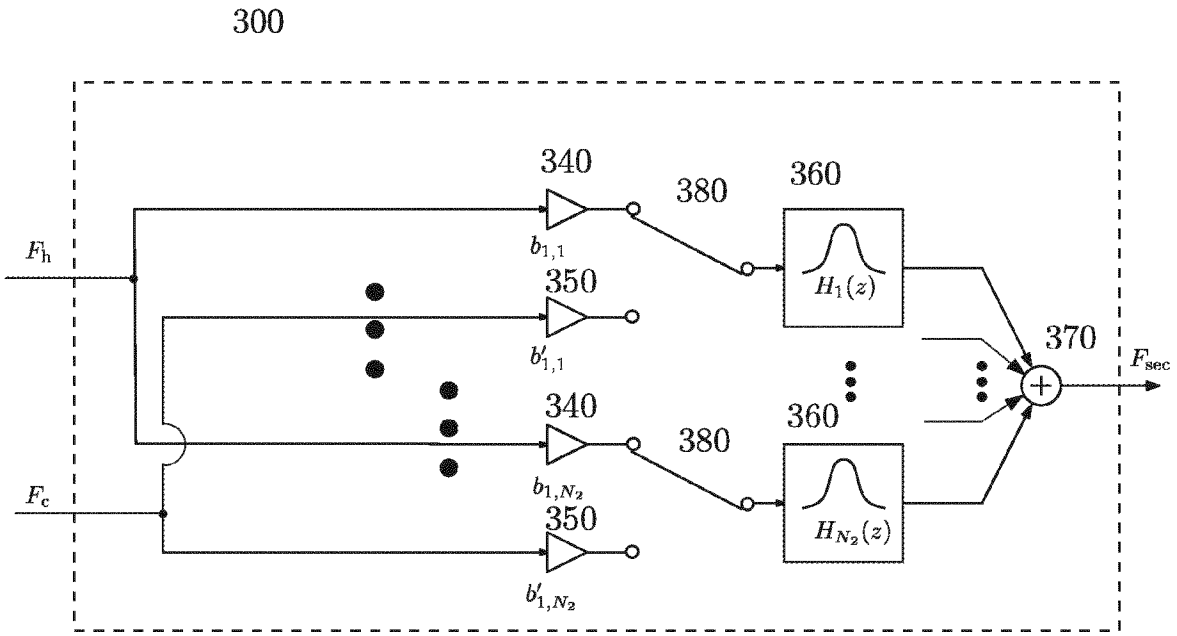
FIG. 4 is a block diagram that illustrates a module of FIG. 1 in detail, realizing the synthesis of the secondary oscillatory components produced by playing the K-th note of the piano.

FIG. 4 illustrates in detail the secondary resonator module (300) comprising a secondary resonator filter bank (360) used to synthesize the secondary oscillatory components produced when playing the K-th note. Each secondary resonator filter (360) of the bank, suitably set in the parameters of the corresponding resonance, receives the force signal $F_h$ sent also to primary (210) and longitudinal (270) resonators.

The force signal ($F_h$) is scaled by the corresponding gain (340), whose value is determined by the theory in the cited literature (BANK, ZAMBON & FONTANA).

A switch (380) is connected to each secondary resonator filter (360), switching between a position (A) in which it connects the gain (340) and another position (B) in which it connects a gain (350) where an active note signal ($F_c$) is fed.

Referring to FIG. 1, the active note signal ($F_c$) entering the secondary resonator module comes from the sum of the various signals, as illustrated in detail hereinafter.

Going back to FIG. 4, when the module of the respective hammer (100) becomes active, the switches (380) are set to position (A) and remain in such a position until the hammer completes its action, thus controlling the beats of the envelopes of the partial components of the strings of the K-th note through the action of filters (360). In fact, the filters (360) are respectively tuned in such a way to generate very low frequency beats with the primary oscillatory components associated with the same partial components, which are translated in envelope alterations.

When the force signal ($F_h$) becomes constantly null, the switches (380) change state (moving to position (B)), allowing for circulation in the filter bank (360) of the active note signal ($F_c$) containing the primary oscillatory components, as well as the resonance impulses of the keys active in that moment, globally scaled by gain (350) before introduction into the respective filter (360).

The outputs of all filters (360) are added by means of an adder (370) that superimposes the output of all filters (360), forming a signal of secondary components ($F_{sec}$) outgoing from the secondary resonator module (300).

Going back to FIG. 1, the system (1) comprises:

- a first adder (920) in which all resonance impulse signals ($F_{h,res}$) outgoing from the various hammers (100) are summed;
- a second adder (960) in which all primary component signals ($F_{prim+quad}$) outgoing from the primary resonators (210) of the various primary and longitudinal resonator modules (200) are summed; and
- a third adder (940) that sums the outputs of the first adder (920) and the second adder (960) to obtain the active note signal ($F_c$) that is fed to the secondary resonator modules (300).

Each secondary resonator module (300) receives the active note signal ($F_c$) when the respective hammer is not active. In view of the second adder (960) each secondary module (300) collects the primary oscillatory component signals ($F_{prim+quad}$) coming from all active primary modules (200), each of them scaled through a respective gain (800).

In view of the first adder (920), each secondary module (300) collects the resonance impulse signals ($F_{h,res}$) coming from all active hammers (100), each of them scaled through a gain (750).

The outputs from the first adder (920) and the second adder (960) are summed by means of the third adder (940) and globally scaled by a gain (900), in such manner to form the active note signal ($F_c$) that contains information from the strings and hammers of each active note. Because of such a mechanism, the system of the invention controls the synthesis of partial components produced by means of sympathetic resonance by all strings, as well as the synthesis caused by the harmonic part of the hammer strike peculiar of each hammer.

Figure 5:
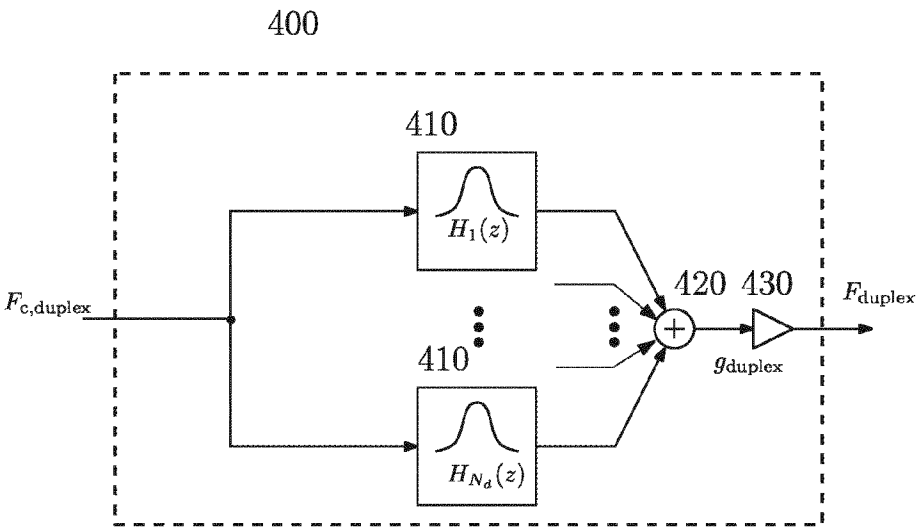
FIG. 5 is a block diagram that illustrates a module of FIG. 1 in detail, realizing the synthesis of the duplex oscillatory components produced by playing the K-th note of the piano.

FIGS. 1 and 5 illustrate the duplex module (400) comprising a resonator filter bank (410) used to synthesize the duplex oscillatory components produced when playing the K-th note. Each filter (410) of the bank, suitably set in the resonance parameters as determined by the theory, receives a duplex force signal ($F_{c,duplex}$) that is a scaled version of a gain (850) of the sum of all harmonic impulse signals ($F_{h,res}$) coming from the hammers (100), which correspond to the keys played in that moment.

The various signals outgoing from the filters (410) of the duplex module are summed by means of an adder (420) and the resulting signal is scaled by means of a gain (430) in such a way to obtain a duplex signal ($F_{duplex}$) that is emitted in output from the duplex module (400).

Figure 6:
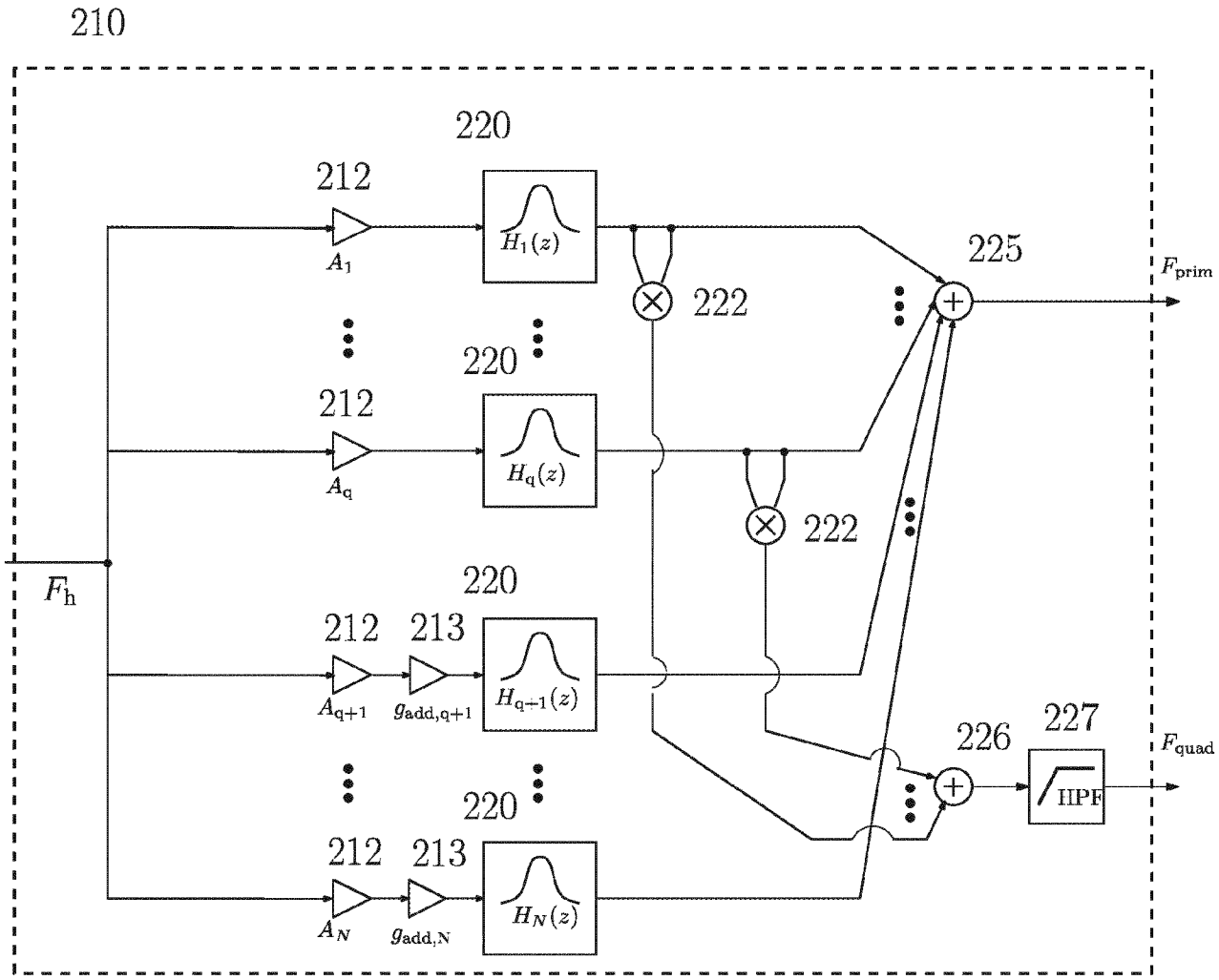
FIG. 6 is a block diagram that illustrates a module of FIG. 3 in detail, synthesizing the primary oscillatory components of the strings of the K-th note of the piano.

Referring to FIGS. 3 and 6, the primary resonator module (210) comprises a resonator filter bank (220) used to synthesize the primary oscillatory components of the strings of the K-th note. Each filter (220) of the bank, suitably set in the resonance parameters as determined by the theory, receives the force signal $F_h$ from the hammer downstream a multiplication by a gain (212), the value of which is established by the theory.

The signal values outgoing from each filter (220) are squared by a multiplier (222) in such a way to obtain the corresponding quadratic oscillatory components. Said quadratic oscillatory components are globally superimposed by means of an adder (226) and finally sent to a high-pass filter (227) from which a quadratic signal ($F_{quad}$) is generated. Likewise filter (240), the high-pass filter (227) is adapted to remove the very low frequency continuous components from the signals outgoing from the multipliers (222). In such away, the quadratic signal ($F_{quad}$) containing the tension modulation harmonics of the strings of the K-th note is emitted by the primary resonator module (210).

As shown in FIG. 6, the primary resonator module (210) is provided with resonator filters (220) without multiplier (222) in downstream position. In this case the signals outgoing from said filters are not associated with any tension modulation harmonics of the string. In particular, each of the respectively modeled oscillatory components does not correspond to any secondary oscillatory component produced by a corresponding secondary resonator module (300). For this reason, the respective modeled partial component is scaled by a constant factor represented by an additional gain (213) upstream the filter (220).

Vice versa, the filters (220) of the bank associated with a tension modulation harmonic always correspond to a secondary resonator suitably tuned in its parameters, adapted to control the envelope beats of the corresponding partial component; for the same reason, the signal entering these filters is not scaled by the constant factor expressed by the gain (213). In both cases, the outputs from the resonator are globally superimposed by means of a second adder (225) to form a primary output signal ($F_{prim}$) containing the primary oscillatory components of the K-th note.

Figure 7:
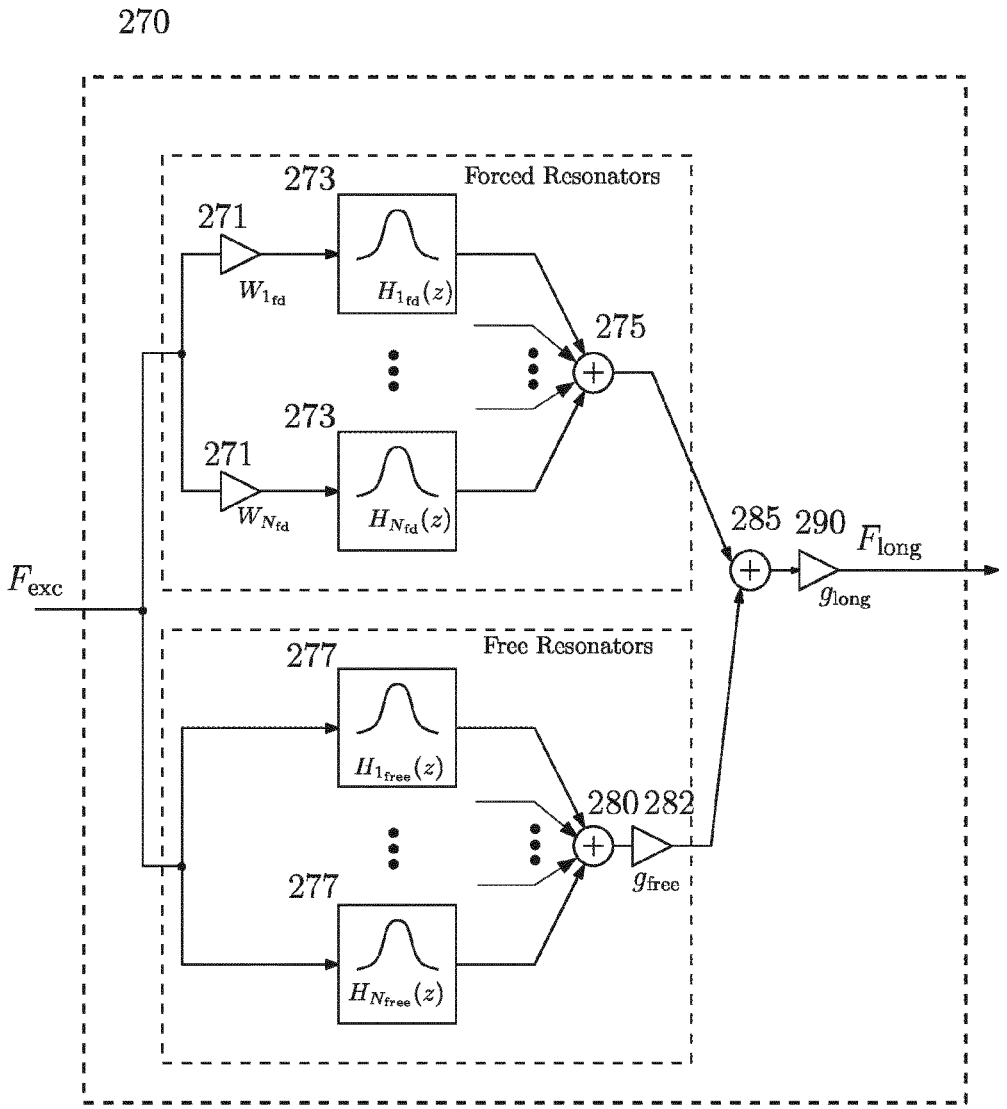
FIG. 7 is a block diagram that illustrates a module of FIG. 3 in detail, synthesizing the longitudinal oscillatory components of the strings of the K-th note of the piano.

Referring to FIGS. 3 and 7, the longitudinal resonator module (270) comprises a forced resonator filter bank (273) and a free resonator filter bank (277) used to synthesize the longitudinal oscillatory components of the strings of the K-th note.

Each free resonator filter (273) of the bank, suitably set in resonance parameters, receives the excitation force signal ($F_{exc}$) from the hammer downstream the multiplication by a gain (271). The global superimposition of the oscillatory components, obtained by means of an adder (275), represents the set of the longitudinal components for the strings of the K-th note.

In case of the aforementioned longitudinal oscillatory components, the system of the invention provides for realizing the synthesis differently from what provided for by the prior art. In fact, the theory provides for realizing a certain number of signal products (or "loop modulations") between certain partial oscillatory components belonging to the same string; each of these products represents an excitation force component of a corresponding longitudinal mode of the string. Now the force component is filtered through a "forming" pass-band filter, the impulse response of which models the free response of the same longitudinal mode. Therefore a corresponding forced longitudinal oscillatory component of the string is present at the output of the forming filter.

Unlike this procedure, the system of the present invention provides for using the signal outgoing from the high-pass filter (240) of FIG. 3 as source to feed the gains (271) and the forced resonator filter bank (273), respectively set in the scale value and tuned in the resonance parameters in such manner to exactly return the forced longitudinal oscillatory components. More precisely, if n and m are indexes of partial oscillatory components originating an excitation force component of a longitudinal mode indexed with k, then this mode excites a forced longitudinal oscillatory component of parameters $$f_k=f_m+f_n$$

$$T_k=(T_mT_n)/(T_m+T_n)$$

$$A_k=|H(f_k)|(A_mA_n)^{1/2}$$

wherein |H(f)| is the free amplitude response of the longitudinal mode, whose value in correspondence of frequency $f_k$ of the excitation force component is selected.

The novelty introduced to synthesize the longitudinal oscillatory components compared to the prior art consists of the fact the forming filters respond to the signal coming from the hammers and therefore resonate excessively during the note attack step. For this reason the system of the invention provides for excluding these filters from the synthesis chain of the longitudinal oscillatory components. Nevertheless, the transient components produced by them are crucial for the accurate sound synthesis due to the longitudinal motion of the strings.

The solution of the invention is to add a second forming filter bank (277) that reproduces the free response components in parallel to the resonator bank (273) for reproduction of the forced longitudinal oscillatory components. The outputs from the free resonator filters (277) are added by means of an adder (280) and the resulting signal is scaled by means of a gain (282).

In this way, the transient components caused by the free response can be synthesized and simultaneously kept under control thanks to the gain (282), which scales their amplitude without affecting the longitudinal oscillatory components. The outputs from the two banks (273, 277) are finally superimposed by means of an adder (285) and scaled by a gain (290) to form a longitudinal component signal ($F_{long}$).

Figure 8:
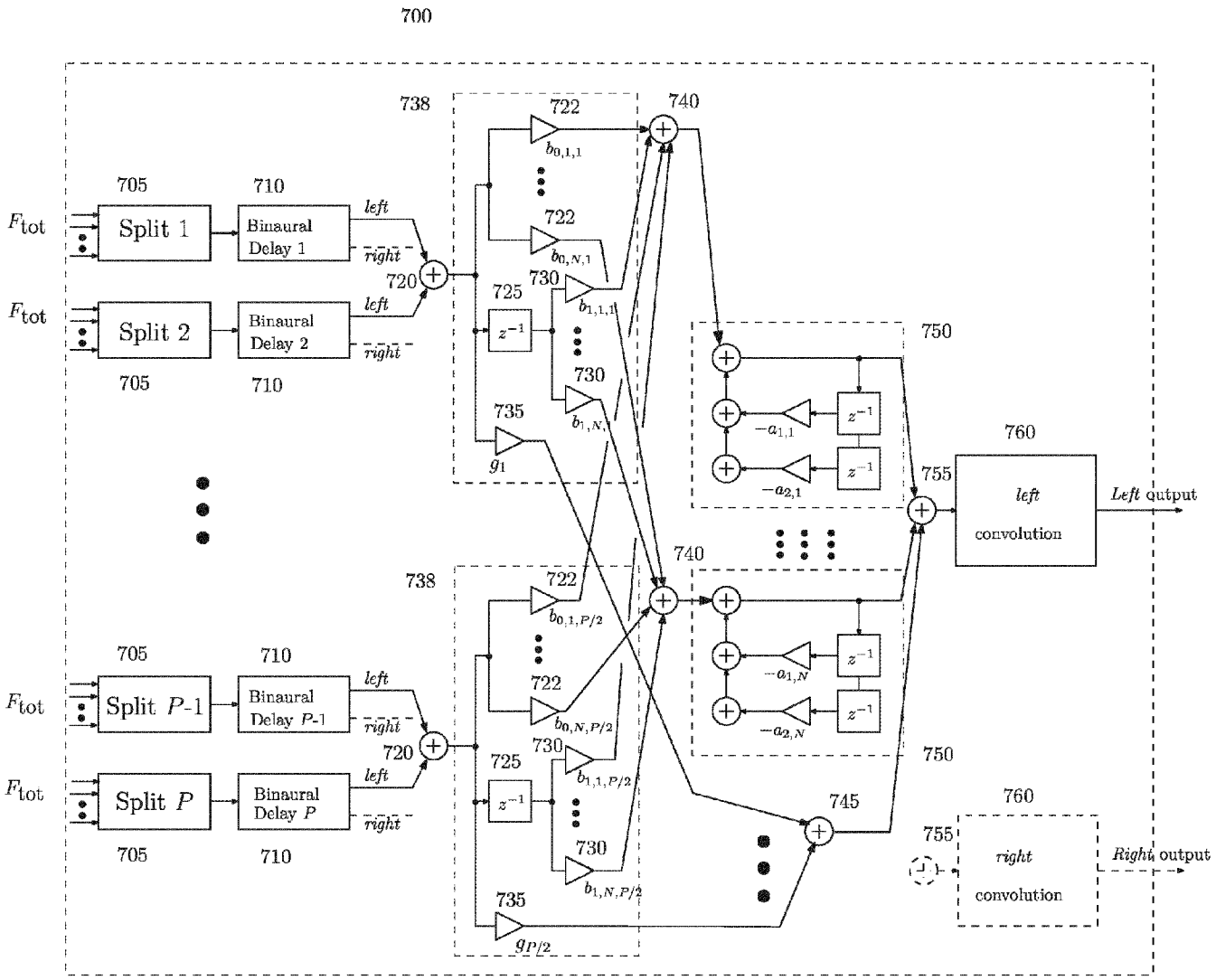
FIG. 8 is a block diagram that illustrates a module of FIG. 1 in detail, realizing the processing of the oscillatory components globally coming from the strings by the soundboard-piano body.

FIG. 8 illustrates the soundboard-instrument body module (700) used to simulate processing, by the soundboard-instrument body, of the oscillatory components generated by the strings. In module (700), the signals of the global partial components ($F_{tot}$) that represent the global partial components corresponding to each note are grouped in P groups or "splits" (705), each of them subject to a structurally identical processing, but using different filtering parameters upon split variation. Such a difference is motivated by the fact that each processing depends on the position in the soundboard of the point in which the strings are coupled to the bridge, through which the oscillatory components associated with a note are transmitted to the soundboard and, by propagating through it, are radiated by the instrument as a whole. On the other hand, such a difference cannot be characterized for each single note, or for each single string, due to unsurpassable limits in terms of computing power of current digital signal processors.

Consequently, the system of the invention proposes an approximate solution to the problem, consisting of grouping multiple notes in the same split, the size of which varies inversely with the available computing power. To each pair of adjacent splits a specific two-step structure based on digital filters is associated, the realization of which is known in the prior art (see Bank, Zambon and Fontana). The first step is composed of two filtering modules (738) and (750), whereas the second step is composed of a convolution module (760).

In view of the novelty proposed by the present system, the design of the first step provides for a considerable saving in computations compared to the use of only signal convolution, regardless of the efficiency of the convolution techniques used, for which reference is made to the literature of the prior art.

Specifically, each split (705) adds the input signals ($F_{tot}$) associated with it, and at the same time selects an optimal lateralization parameter for the sound produced by the notes that are active in that moment on the split. The value of said parameter lateralizes, that is to say shifts laterally with respect to an ideal point located on the center in front of the listener, the position of the acoustic source represented by the sound. In case of a split of piano notes, at every moment this value can correspond to the center of the region that originates the sound, which is a function of the notes of the split that are played in the same moment. Finally, the lateralization parameter value determines a temporal delay value that is used by a block (710) to define two instances of the input signal, one of them being delayed with respect to the other one by the corresponding value. Discrete-time lateralization models of the acoustic source based on the relative delay between pairs of otherwise identical signals, which contain the same source sound, are known in the prior art.

The signals outgoing from the left channel of each block (710) of the corresponding split pair are summed by means of an adder (720) and processed by the first step, consisting of a bank of N all-zero second-order digital filters (738) and a bank of N all-pole second-order digital filters (750). Assuming to define an even split number P, with reference to the P/2-th split pair of FIG. 8, the i-th filter of the bank with N elements has a transfer characteristic equal to:

$$H_{i,P/2}(z) = \frac{b_{0,i,P/2} + b_{1,i,P/2}z^{-1}}{1 + a_{1,i}z^{-1} + a_{2,i}z^{-2}} + g_{P/2}$$

Being the poles of the i-th filter of each bank common to all splits, the inputs at the bank filters having the same index i can be individually processed by the all-zero part (738) of the filter, the output of which is sent to processing by the common-pole part (750) of the i-th filter.

In practical terms, the signal outgoing from the adder (720) of the P/2-th pair is processed by the N all-zero filters (738), each of them being respectively characterized by coefficient $b_{0,i,P/2}$ of a gain block (722), and in parallel by the delay element $z^{-1}$ (725) in series to coefficient $b_{1,i,P/2}$ (730). When all signals outgoing from the respective adders (720) have been processed by the corresponding all-zero filters (738), the sum (740) of P/2 signals, each of them outgoing from the i-th all-zero filter of the bank is sent to the i-th all-pole filter (750), respectively characterized by coefficients $-a_{1,i}$ and $-a_{2,i}$ to complete the filtering operation.

The second processing step completes the global characterization of the soundboard-instrument body for the left signal of all notes. The convolution module (760) receives the sum (755) of the outputs from the all-pole parts (750) of the N filters, in parallel to the sum (745) of the P/2 inputs at the corresponding filter banks, scaled by the respective gains (735) forming the second order transfer characteristic $H_{iP/2}(z)$ illustrated above. A similar processing is carried out for the right signal outgoing from all blocks (710), which undergoes a structurally identical processing, except for the values assumed by the coefficients of the respective common zero-pole second-order transfer characteristics and by the parameters of the relative convolution block.

Although the identification and extraction of 2N common poles from a set of transfer characteristics is illustrated and motivated by the prior art (see Y. Haneda, S. Makino, and Y. Kaneda, "Multiple-point equalization of room transfer functions by using common acoustical poles," IEEE Trans. Speech Audio Processing, vol. 5, no. 4, pp. 325-333, 1997), the specific application of such a methodology to a multidimensional pole-zero model able to characterize the soundboard and the instrument body is a novelty proposed in the system of the invention.

In the specific case of filter banks with N elements as illustrated above, the system of the present invention provides for selecting 2N common poles from a set of target transfer characteristics. The characteristics are obtained from measurements of the response of the soundboard-instrument body: first, by disaggregating from the measurements information common to all responses, which characterizes the second step, or convolution; successively, by identifying the aforementioned characteristics as residues of the same responses after extracting the common information from them.

After selecting the common poles, the NP zero positions are optimized to define N(P/2) second-order common-pole filters able to minimize, for each N(P/2) input/output pair, the sum of the quadratic errors with respect to the target characteristics.

The use of P/2 banks with N common-pole second-order filters allows for considerably reducing the computational load of the module (700) compared to the cost in case of realization of N(P/2) second-order filters having distinct poles. In fact, such a reduction allows for avoiding the calculation of N(P/2)−N=(N−1)(P/2) all-pole second-order equivalent filters, without appreciable loss of model accuracy.

The invention claimed is:

1. A system to reproduce the sound of a stringed instrument having hammers that strike strings, the system comprising:

a speed detection means coupled with each hammer to detect a percussion velocity on the string, a plurality of note modules, equal to a number of hammers, receiving an input signal representative of a hammer velocity and generating a force signal ($F_{tot}$) representative of all partial components of a string vibration, and a soundboard-instrument body module receiving in input said force signal ($F_{tot}$) from each note module and generating two electrical signals (left, right) adapted to power two electroacoustic transducers for sound emission;

wherein each note module of said plurality of note modules comprises:

a hammer module receiving in input the hammer velocity signal and generating a force signal ($F_h$) reproducing an evolution across time of a force with which the hammer strikes the strings when playing "fortissimo" dynamics and a resonance impulse signal ($F_{h,res}$) reproducing an evolution across time of a force transmitted to the strings by the hammer when playing the "fortissimo" dynamics, both the force signal ($F_h$) and the impulse resonance signal ($F_{h,res}$) being a function of a hammer impact velocity;

a primary and longitudinal resonator module receiving in input said force signal ($F_h$) from the hammer module and generating a force signal ($F_{prim+quad}$) representative of a linear and quadratic primary component of the string vibration and a force signal ($F_{long}$) representative of a longitudinal component of the string vibration;

a secondary resonator module receiving in input said force signal ($F_h$) from the hammer module and an active note module ($_{Fc}$) obtained from a sum of said resonance impulse signals ($F_{h,res}$) and from a sum of the force signals of primary and quadratic component ($F_{prim+quad}$) and generating a force signal ($F_{sec}$) representative of a secondary component of the string vibration; and a duplex resonator module receiving in input said force signal ($_{Fc,\ duplex}$) obtained from a sum of said resonance impulse signals ($F_{h,\ res}$) and generating a force signal ($F_{duplex}$) representative of a duplex oscillatory component of the string vibration;

said force signal of the primary component ($F_{prim}$), a force signal of a longitudinal component ($F_{long}$), the force signal of the secondary component ($F_{sec}$) and the force signal of duplex component ($F_{duplex}$) being summed in each note module in such manner to obtain said signal of the partial components ($F_{tot}$) to be sent to said soundboard-instrument body module of the instrument.

2. The system of claim 1, wherein said hammer module comprises:

a signal generator receiving in input the velocity signal of the hammer and generating a force signal reproducing the evolution across time of the force with which the hammer strikes the strings of the key during the execution of the "fortissimo" dynamics, a pulse generator generating a resonance impulse signal reproducing an evolution across time of the force transmitted to the strings by the hammer during the execution of "fortissimo" dynamics, a first low-pass filter and a second low-pass filter to filter said force signal generated by the signal generator;

a third low-pass filter to filter said resonance impulse signal from said pulse generator.

3. The system of claim 1, wherein said primary and longitudinal resonator module comprises:

a primary resonator module receiving in input said force signal ($_{Fc}$) from the hammer module and generating a force signal of the primary component ($F_{prim}$) and a force signal of the quadratic component ($F_{quad}$);

a gain to scale the force signal of the quadratic component ($F_{quad}$);

an adder to sum said force signal of the primary component ($F_{prim}$) to the scaled force signal of the quadratic component ($F_{quad}$);

a low-pass filter receiving in input said force signal ($_{Fc}$) from the hammer module;

a multiplier downstream of said low-pass filter;

a high-pass filter downstream of said multiplier; and a longitudinal resonator module downstream of said high-pass filter.

4. The system of claim 3, wherein said primary resonator module comprises:

a plurality of resonance filters;

a first adder summing all outputs of said plurality of resonance to obtain said force signal of the primary component ($F_{prim}$);

multipliers downstream of at least some of said plurality of resonance filters;

a second adder summing all outputs of said multipliers; and a high-pass filter downstream of the second adder to obtain said force signal of the quadratic component ($F_{quad}$).

5. The system of claim 3, wherein said longitudinal resonator module comprises:

a plurality of forced resonance filters;

a first gain downstream of each of said plurality of forced resonator filters;

a first adder summing all outputs of said plurality of forced resonance filters;

a plurality of free resonance filters;

a second adder summing all outputs of said plurality of free resonance filters;

a second gain downstream the second adder;

a third adder summing outputs from the first adder and second adder; and a third gain downstream of the third adder to obtain said force signal of the longitudinal component ($F_{long}$).

6. The system of claim 1, wherein said secondary resonator module comprises:

a first gain rescaling said force signal ($F_h$) from the hammer module;

a second gain rescaling said active note signal ($_{Fc}$);

a plurality of resonance filters;

a switch connected to each resonance filter and adapted to switch from a first position where said switch connects said first gain and a second position where said switch connects said second gain; and an adder summing all outputs of the plurality of resonance filters to obtain said force signal of the secondary component ($F_{sec}$).

7. The system of claim 1, wherein said duplex module comprises:

a plurality of resonance filters receiving in input a force signal ($F_{c,duplex}$) obtained from a sum of said resonance impulse signals ($F_{h,res}$);

an adder summing outputs of said plurality of resonance filters; and a gain downstream of said adder to obtain said duplex force signal ($F_{duplex}$).

8. The system of claim 1, wherein said soundboard-instrument body module comprises:

a plurality of splits wherein each split receives in input said signals of the partial components ($F_{tot}$) from all note modules;

a plurality of binaural delays, wherein each binaural delay is downstream of each split and generates in output two electrical signals (left, right) adapted to control an electroacoustic transducers;

first adders to sum outputs of said binaural delays;

all-zero filters downstream of said first adders;

second adders to sum outputs of said all-zero delays;

all-pole filters downstream of said second adders;

two final adders summing outputs of said all-pole filters with the outputs from said first adders respectively for the signal (left) and the signal (right); and two convolution modules downstream of said two final adders to follow a convolution of the signal and obtain said two electrical signals (left, right) per drive of said electroacoustic transducers.

* * * * *